US006974032B2

(12) United States Patent
Intini

(10) Patent No.: US 6,974,032 B2
(45) Date of Patent: Dec. 13, 2005

(54) BEND AND PEEL PACKAGING HAVING CONTROLLABLE DELAMINATION

(76) Inventor: Thomas D. Intini, 9270 Recollet Street, Brossard, Quebec (CA) J4X 1B9

( * ) Notice: Subject to any disclaimer, the term of this patent is extended or adjusted under 35 U.S.C. 154(b) by 0 days.

(21) Appl. No.: 10/629,946

(22) Filed: Jul. 30, 2003

(65) Prior Publication Data

US 2005/0023180 A1 Feb. 3, 2005

(51) Int. Cl.[7] ..... B65D 85/42; B65D 83/04
(52) U.S. Cl. ..... 206/532; 206/534.1; 206/539
(58) Field of Search ..... 206/461, 462, 206/469, 471, 528, 534.1, 534.2, 536, 538, 206/539, 532

(56) References Cited

U.S. PATENT DOCUMENTS 3,630,346 A * 12/1971 Burnside ..... 206/532
3,872,970 A * 3/1975 Edison ..... 206/532
4,243,144 A * 1/1981 Margulies ..... 206/532
4,762,230 A * 8/1988 Croce ..... 206/469
4,781,294 A * 11/1988 Croce ..... 206/469
4,988,004 A * 1/1991 Intini ..... 206/532
5,172,812 A * 12/1992 Wharton et al. ..... 206/531
5,862,915 A * 1/1999 Plezia et al. ..... 206/528
5,894,930 A * 4/1999 Faughey et al. ..... 206/532
5,944,191 A * 8/1999 Ray et al. ..... 206/532
6,131,737 A * 10/2000 Marshall ..... 206/471

* cited by examiner

*Primary Examiner*—John A. Ricci
(74) *Attorney, Agent, or Firm*—Eric Fincham

(57) ABSTRACT

A bend and peel child resistant and senior friendly tamper evident package comprising a blister sheet having blister pockets projecting from a front side thereof, a rupturable foil layer being adhered to the blister layer and reinforcing the paperboard material adhered to the foil layer, the paperboard layer having a tear strip formed therein, the tear strip being defined by a cut into the paperboard layer from the side thereof adhered to the foil layer, the cut extending only a certain percentage of the total thickness of the paperboard such that a controlled delamination of the paperboard layer occurs when the tear strip is removed. This provides a precise reinforcement of the foil layer.

3 Claims, 7 Drawing Sheets

BEND AND PEEL PACKAGING HAVING CONTROLLABLE DELAMINATION

FIELD OF THE INVENTION

The present invention relates to a tamper evident, senior friendly and child resistant package of the type operable by means of a tear strip.

BACKGROUND OF THE INVENTION

Blister packs are well know in the art and are widely used to package individual items such as different forms of medication including tablets, capsules and the like. In addition, the packaging of a small amount of liquid in an individual blister is known.

Usually, the item or product is accessed through the rear of the blister pack which is provided with a tear strip.

As aforementioned, there are three different properties which any packaging ideally possesses. The first is that the package should be tamper evident such that there will be provided a clear indication when the package has been subject to tampering. A second feature is that the package be child resistant. As aforementioned, such packages are frequently used for medication and it is inherently desirable that one prevents young children from accessing the contents of the blister pack.

However, in making such packaging child resistant, it is also important that the package still be readily openable by those taking the medication. Since the most frequent users of medication are seniors, one must take into account the limits of their ability when they are suffering from various physical problems.

A conventional blister package usually comprises a laminate of a blister layer having article receiving pockets formed therein and with the article receiving pockets being covered by a foil backing layer. This foil backing layer is usually a form of an aluminum foil which is rupturable to permit access to the product in the blister pocket. While such a package is inherently tamper evident unless the whole foil layer is replaced, it is not very child resistant and indeed can prove attractive to some children.

To overcome this, there has been suggestions in the art, such as shown in U.S. Pat. No. 4,537,312 to Intini, to include such certain child resistant features. In the arrangement of Intini, there is provided a blister package having a front layer and outer back layer which are sized larger than the conventional package and sealed to one another around their periphery and through apertures in the laminate. Tabs are provided at the edges of the sealed front and back layers and which tabs are connected to tear strips in the back layer, each of which overlays the foil covering a blister pocket. On removing the tear strips in the back layer, there will be left a layer or stratum of paperboard which overlays the foil to thereby reinforce it and make it more difficult for the child to access the product in the blister pocket.

A further feature which must always be considered in designing such products is the ability to efficiently manufacture the package at a reasonable cost. It is also highly desirable that the results be reproducible.

SUMMARY OF THE INVENTION

It is an object of the present invention to provide blister pack packaging which is tamper evident, senior friendly and child resistant.

It is a further object of the present invention to provide blister pack packaging which is easy to manufacture and overcomes some of the deficiencies of the prior art packaging.

According to one aspect of the present invention, there is provided a child resistant and senior friendly tamper evident package, the package comprising a blister sheet having at least one blister pocket projecting from a front side thereof, a rupturable foil layer sealed to a back side of the blister sheet to form a continuous cover over the blister pocket, the foil layer having a thickness and being formed of a material which can be ruptured to provide access to the pocket, a reinforcing layer of a paperboard material, the reinforcing layer having a first side with at least portions thereof adhered to the foil layer, at least some of the adhered portions being in registry with the blister pockets, the paperboard layer having at least one line of weakening extending from the first side into the board, at least one line of weakening being located in a portion overlying the blister packet, at least one line of weakening extending into said board for only a portion of the thickness of the board, and a tear strip formed in said reinforcing layer, the tear strip being associated with the blister pocket such that the reinforcing layer will delaminate when the tear strip is pulled.

According to a further aspect of the present invention, there is provided a child resistant and senior friendly tamper evident package, the package comprising a blister sheet having at least one blister pocket projecting from a front side thereof, a depression formed in the blister sheet adjacent the blister pocket, a rupturable foil layer sealed to a back side of the blister sheet to form a continuous cover over the blister pocket, a paperboard layer having portions thereof adhered to the foil layer, a tear strip being formed in the paperboard layer, the tear strip being adhered to the foil about the periphery of the tear strip, a tab member connected to the tear strip at one end thereof, the arrangement being such that when the tab and tear strip are removed, the foil then can be ruptured adjacent to the depression and the foil removed.

In a still further aspect of the present invention, there is provided a child resistant and senior friendly tamper evident package comprising a blister sheet having at least one blister pocket projecting from a front side thereof, a foil layer adhered to a back side of the blister sheet to form a continuous cover over the blister pocket, a reinforcing layer of a paper board material, the reinforcing layer having a first side with at least portions of the first side adhered to the foil layer, a tear strip formed in the paperboard layer, the tear strip overlying the blister pocket, the tear strip having a first tab at a first end thereof and being connected to the tear strip, a second tab at a second end of the tear strip end being separated from the tear strip by a cut through the paperboard layer, each of the tabs being non adhered to the foil layer, and the foil having a gripping portion to enable grasping thereof, the gripping portion being exposed upon removal of the second tab.

In a first embodiment of the invention, the delamination of the paperboard and the ability to eject the product from the pocket is controlled by providing a line of weakening formed in the paperboard on the face line adjacent to the foil. This line of weakening permits the product to be dispensed from the blister pocket with less effort than would otherwise be the case. At the same time, the line of weakening is not evident to a child since it does not extend through that portion of the paperboard which remains covering the blister pocket.

In a further aspect of the present invention, the tear strip is interconnected to a tab and which tab is designed to be lifted to pull the paperboard material from the back of the foil. In this respect, the paperboard is only adhered to the foil about the periphery of the blister pocket.

After removal of the paperboard material, the foil may be removed by pushing the foil in the area of a depression formed in the blister layer. This prevents removal of the foil with less effort than would otherwise be the case.

The contents in the blister pocket are conventionally tablets or capsules or the like. However, as will be shown in the description of the preferred embodiments, the package of the present invention can be utilized with liquids and the like.

The materials utilized in the present invention are well known in the art. Thus, the blister layer may be formed with a number of blister pockets projecting from a front side thereof, each designed to receive a unit dosage of a pharmaceutical product or indeed, some other product. The sheet may comprise a normally rectangular continuous blister sheet of a flexible clear material which cannot be easily torn or ruptured. Typically, such a film would be a vinyl thermoplastic film having a thickness in excess of 10 mil.

The rupturable film sealed to the back side of the blister sheet is also well known in the art and may be selected from many known materials. Typically, such rupturable foils are of aluminum material having a thickness in the range of 1 mil and which may be joined to the blister sheet by conventional adhesives such as heat seal or coatings well known in the art.

In those applications wherein a paper layer is utilized, it again may use a heat sealable adhesive and comprise paper having a weight of between 13 pounds to 17 pounds.

The reinforcing layer is preferably a paper product such paperboard. The tear strips in the paperboard layer may be defined by parallel lines of perforations or slits in the outwardly facing side to thereby form longitudinal tear lines which define the tear strip. At one end of the strip, there may be a tab which is not sealed to the foil layer.

In the first embodiment of the present invention, the line of weakening defining the tab may extend into the paperboard for a depth of preferably between 10 and 40% of the thickness of the paperboard and more preferably, approximately 30% of the thickness.

Where the tab joins the tear strip, there is preferably a cut from the inner facing side of the paperboard which extends between 60 and 90% of the thickness of the paperboard.

In the above described embodiment, there is also provided a line of weakening which is cut into the paperboard from the inner side thereof at the position where the capsule will be ejected from the blister pocket. This line of weakening assists in dispensing of the product and may extend into the paperboard for a distance of between 10 and 40% of the thickness thereof.

BRIEF DESCRIPTION OF THE DRAWINGS

Having thus generally described the invention, reference will be made to the accompanying drawings illustrating embodiments thereof, in which.

DESCRIPTION OF THE PREFERRED EMBODIMENTS

Figure 1:
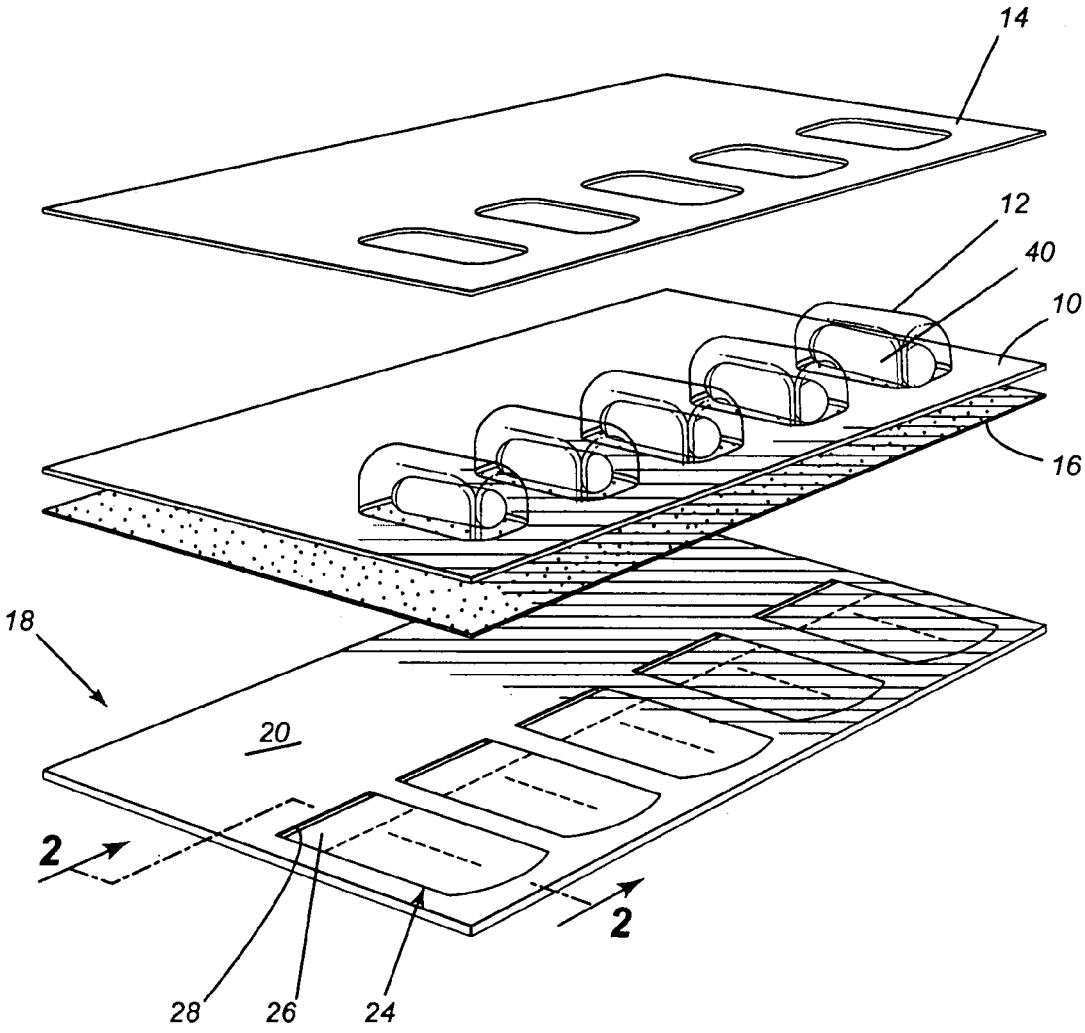
FIG. 1 is an exploded view illustrating the various components of a package according to one embodiment of the present invention.

Referring to the drawings in a greater detail and by reference characters thereto, there is illustrated in FIG. 1 an exploded view of a first embodiment of the present invention. In this embodiment, there is provided a blister layer 10 which has a plurality of blister pockets 12 formed therein in a conventional manner.

Designed to be placed on top of a blister layer 10 is an optional data layer 14. Data layer 14 has cut-outs to receive the blister pockets and may carry pertinent information thereon. To this end, data layer 14 is generally of a paper or paperboard material.

Secured to the underside of blister layer 10 is a rupturable foil layer 16. Such rupturable foil layers are well known in the art.

A paperboard reinforcing layer 18 is secured to rupturable foil layer 16 by means of a conventional adhesive 17. Paperboard layer 18 has a first side which lies adjacent to rupturable foil layer 16 and a second exteriorly facing side.

As is know in the art, tear strips 24 are formed in paperboard layer 18 as described in greater detail herein below. Tear strips 24 each individually overly one of the blister pockets 12 and are defined by a traditional line of weakening.

Figure 2:
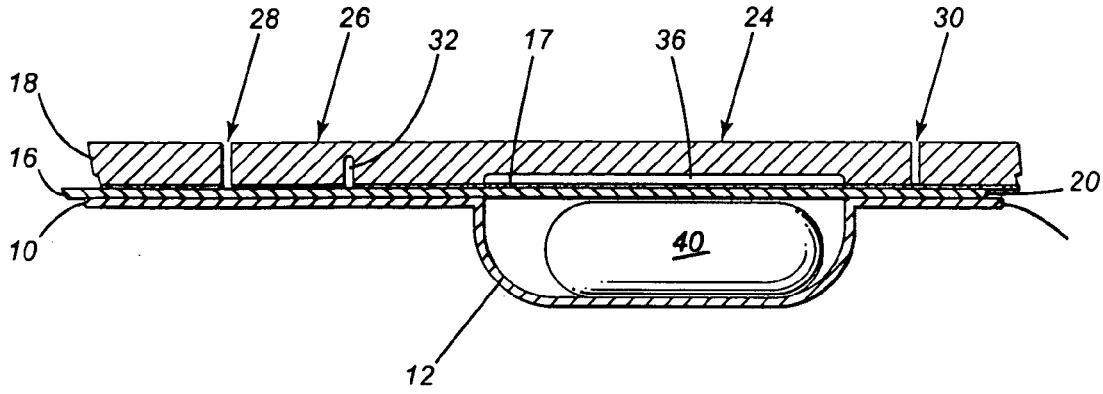
FIG. 2 is a cross-sectional view along the lines 2—2 of FIG. 1 when the package is assembled.

Associated with each tear strip 24 is a tab 26. Tabs 26 are not sealed to foil layer 16 and, as may be seen in FIGS. 2 to 4, each tab 26 is defined by a slit 28 which extends completely through paperboard layer 18. However, at the point where tab 26 meets tear strip 24, there is provided a further slit 32 extending from first side 20 and extending for a depth of approximately 70% of the thickness of the paperboard layer 18.

There is also provided a slit 30 at the distal end of tear strip 24. A partial cut 32, as may be seen in FIGS. 2 through 4, extends through first side 20 of paperboard layer 18. However, partial cut 32 extends to a depth substantially less than that of slit 32 for reasons which will become apparent hereinbelow. Typically, partial cut 30 may extend into paperboard layer a distance approximately equal to 30% of the thickness of paperboard layer 18.

Figure 3:
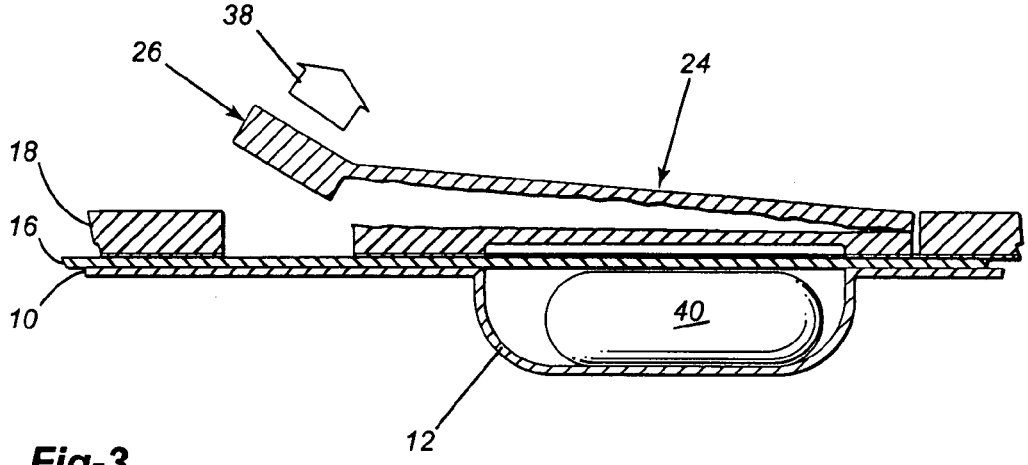
FIG. 3 is a view similar to FIG. 2 illustrating partial opening of the package by delamination of the tear strip.
Figure 4:
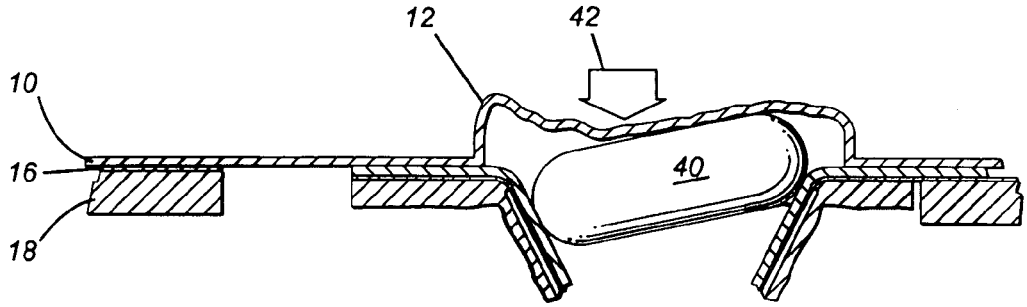
FIG. 4 is a view similar to FIGS. 2 and 3 illustrating the final step in the dispensing of the capsule from the package.
Figure 5:
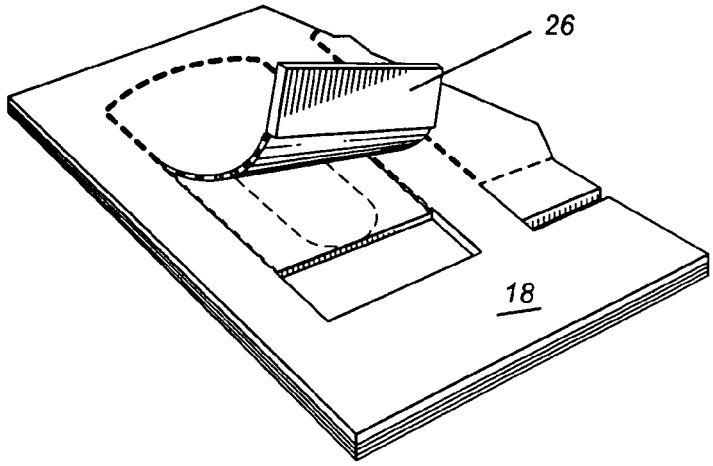
FIG. 5 is perspective view illustrating the first step of FIG. 3 in opening the package.
Figure 6:
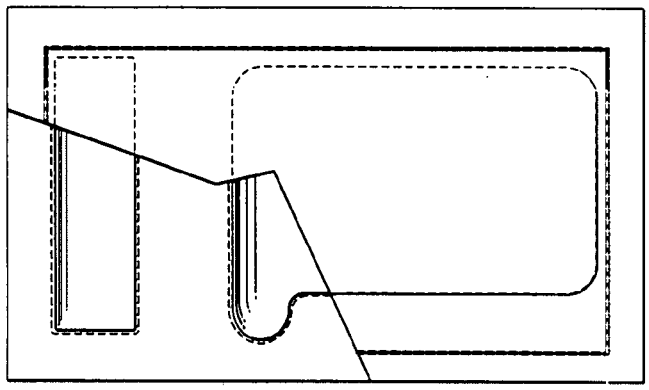
FIG. 6 is a top plan view, partially in cut-away, of a further embodiment of the present invention.
Figure 7:
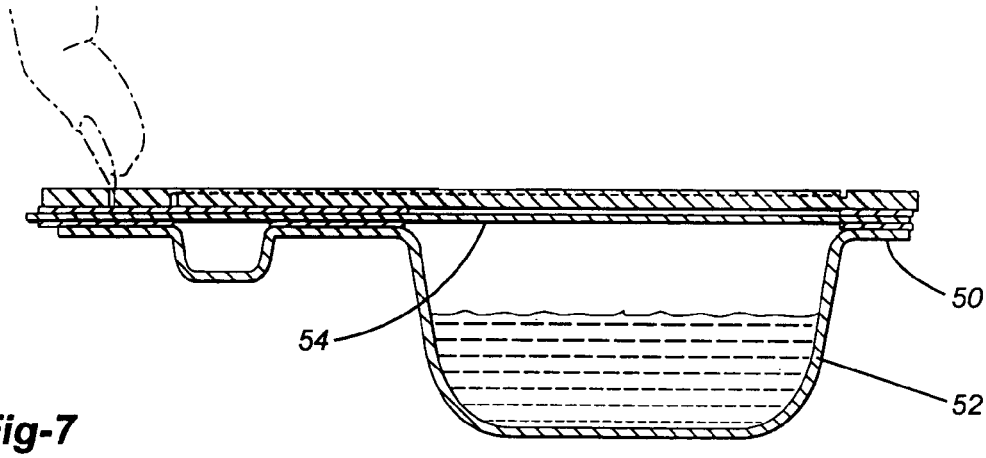
FIG. 7 is a cross-sectional view through a blister pocket of the embodiment of FIG. 6.

In order to provide access to capsule 40 which is contained in blister pocket 12, tab 26 is lifted as indicated by arrow 38 in FIG. 3. As the continued lifting motion is applied, an upper approximately 30% of paperboard layer 18 will tend to delaminate. The extent of the delamination can be controlled by the depth of slit 32. After removing approximately 30% of paperboard layer 18, there will remain 70% of the paperboard layer. However, where partial cut 32 is located, there will be only 40% of the paperboard layer thus permitting easier exit of capsule 40 when pressure is applied to blister pockets 12 indicated by arrow 42.

In the embodiment of FIGS. 6 through 10, there is provided a package which has a blister layer 50, the blister layer 50 having blister pockets 52 formed therein as in the previously described embodiment. A rupturable foil layer 54 is secured by adhesive 56 to the backside of blister layer 50 in a conventional manner. Similarly, there is provided a reinforcing paperboard layer 58 secured to rupturable foil layer 54 by meas of adhesive 60. Tear strips 62 are formed in paperboard layer 58, each tear strips 62 having a tab 64 associated therewith.

In this embodiment, each tear strips 62 and tab 64 is arranged so that they are sealed about the periphery of the blister pocket 52.

Figure 8:
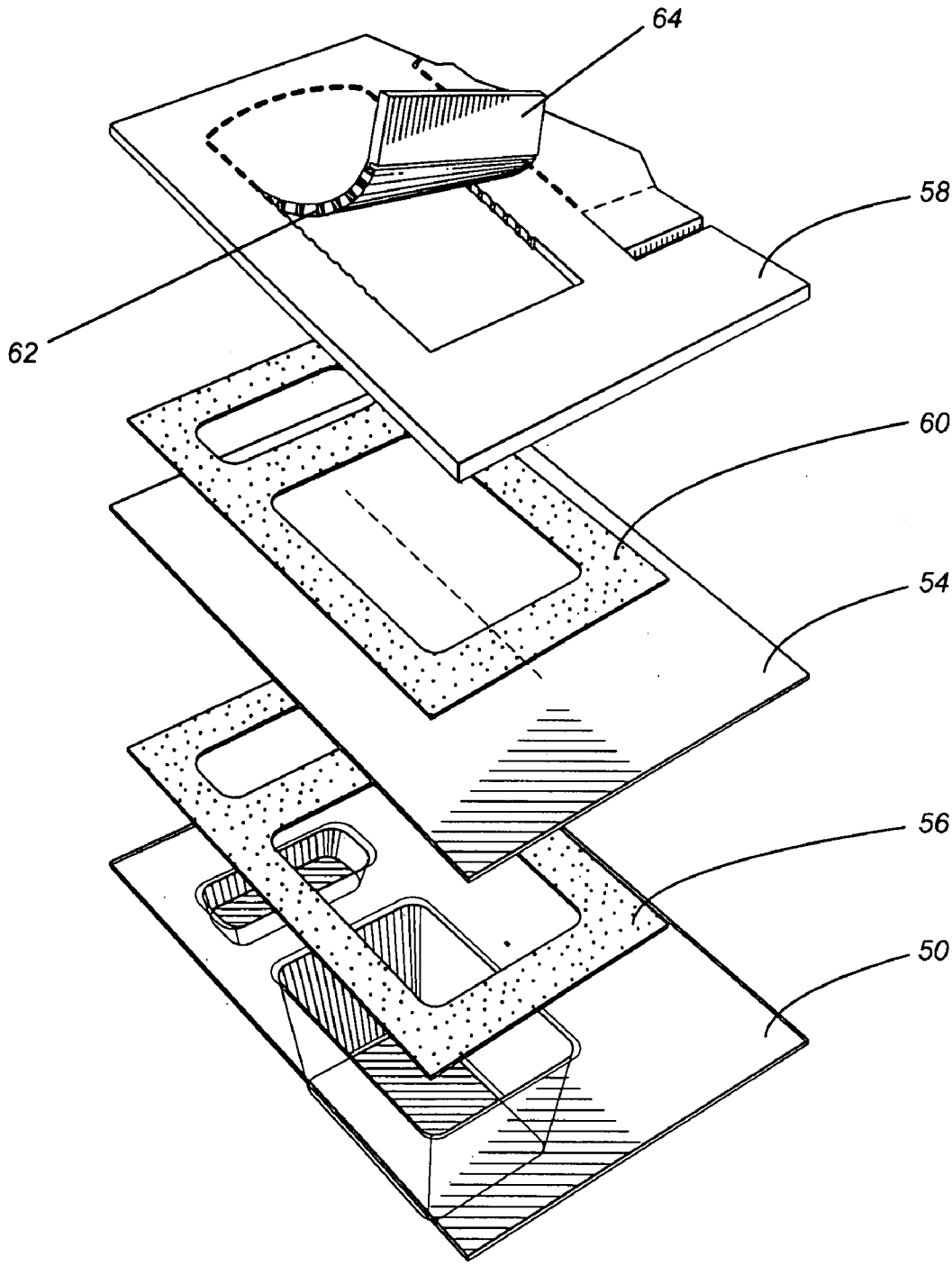
FIG. 8 is an exploded view illustrating the various components of the package of FIG. 6.
Figure 9:
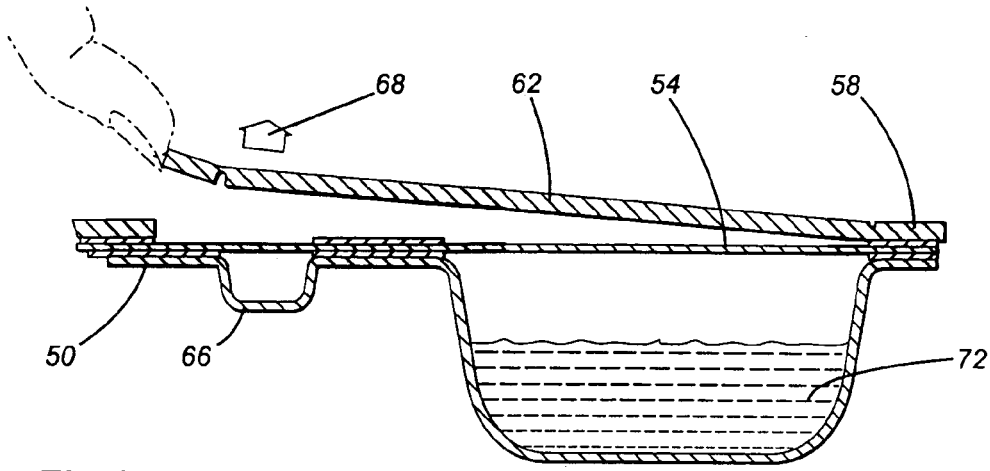
FIGS. 9 and 10 are views similar to FIG. 7 illustrating opening of the package.
Figure 10:
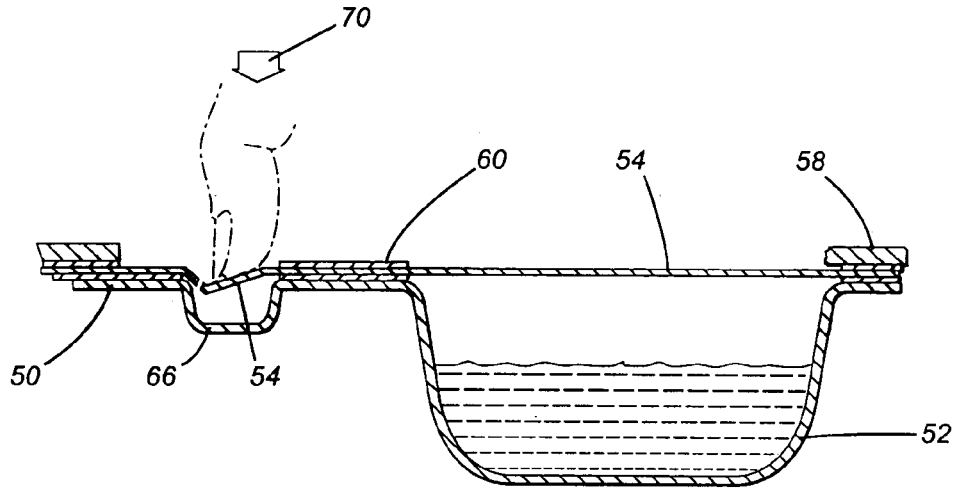

As may be seen in FIGS. 8 and 9, there is also provided a depression 56 formed in blister layer 50. As illustrated in FIG. 9, following removal of the paperboard layer or portions thereof, a finger may then be utilized as indicated by arrow 70 to break the remainder of the paper board layer and foil layer. This foil layer may then be removed from around blister pocket 82 to proved access to the contents of the blister pocket.

Figure 11:
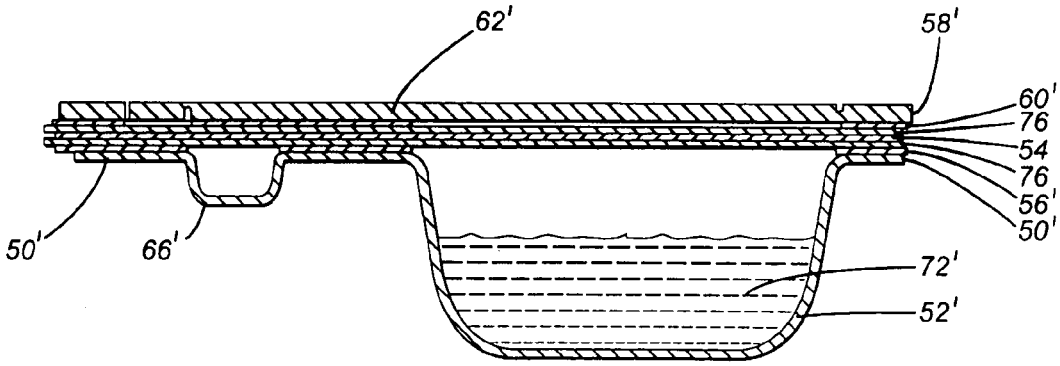
FIG. 11 is a cross-sectional view of a further embodiment of a package similar to that of FIGS. 8 and 9.
Figure 12:
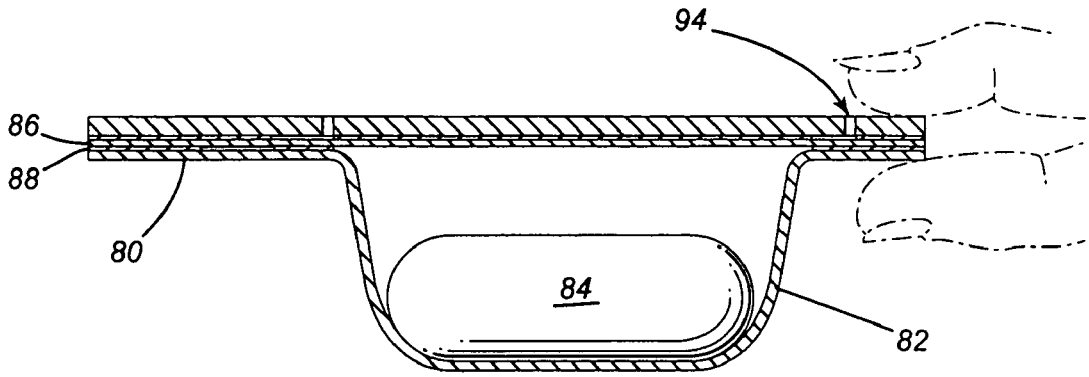
FIG. 12 is a cross-sectional view through a blister pocket of a further embodiment of the present invention.
Figure 13:
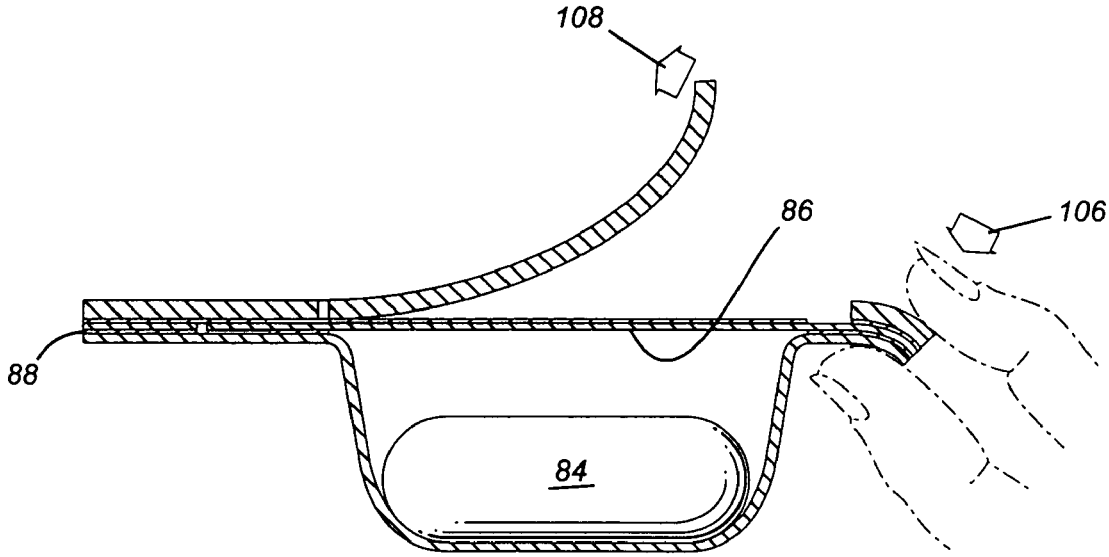
FIGS. 13 to 16 are cross-sectional views similar to FIG. 12 illustrating opening of the package.
Figure 14:
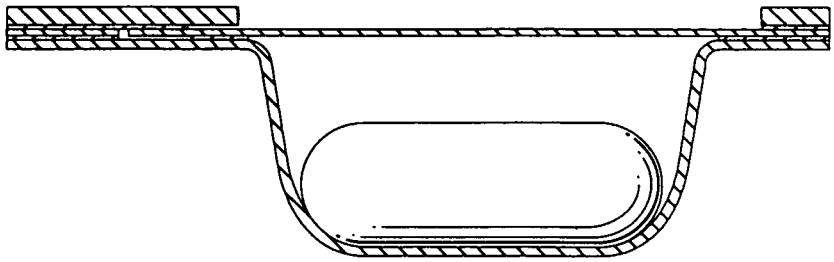
Figure 15:
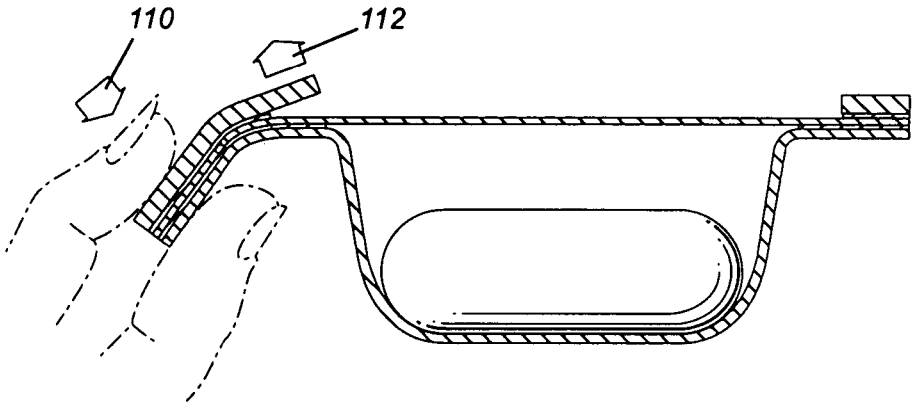
Figure 16:
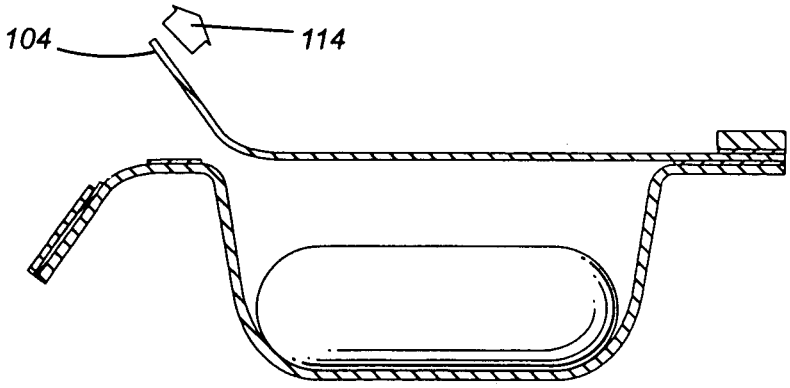

In FIG. 11, there is illustrated a modified version of the embodiment of FIGS. 6 through 10. Accordingly, similar reference numerals with a prime (') are utilized for similar components.

In this embodiment, there is provided a blister layer 50' having a blister pocket 52' which, in the illustrated embodiment, contains a liquid 72'. Naturally, a capsule, tablet or other object could be placed therein.

The foil layer 54' is secured to blister layer 50 by means of adhesive 56 prime. However, on top of foil layer 54', there is provided a paper layer 76 which may be of any desired weight. On top of paper layer 76, there is provided a paperboard layer 58' with adhesive 60'. A tear strip 62' is formed therein. In operation, removal is essentially the same in that paperboard layer 62' is initially removed. However, the reinforcing layer of paper 76 provides additional security to the package. The foil layer 54' and paper layer 76 would be removed together. Also, a thicker foil layer or a foil thin film can also be used instead of the paper/foil.

A still further embodiment of the present invention is illustrated in FIGS. 12 through 16 and reference will now be added thereto.

In this embodiment, there is provided a package which includes a blister layer 80 having a blister pocket 82 therein for containing a capsule 84. Sealed to blister layer by means of adhesive 88 is a foil layer 86. In turn, a paperboard layer 90 is secured to foil layer 86 by means of adhesive 92.

A tear strip 96 has a slit 94 formed at one end thereof. A first tab portion 98 is not adhered to foil layer 86 and access may be gained thereto to completely remove tear strip 96.

At the other end of tear strip 96, there is provided a second tab 102 which is partially defined by slit 100. Thus, as may be seen in FIGS. 12 and 13, a slight pressure on the package will permit access to tab 98 to permit removal of tear strip 96. Removal of tear strip 96 stops at slit 100.

Subsequently, second tab 102, which is likewise not adhered to foil layer 86, may then be removed. Underneath this portion of the paperboard, there is provided a foil layer tab 104 which is likewise not adhered to blister layer 80. This permits removal of the foil layer as illustrated by arrow 114.

It will be understood that the above described embodiments are for purposes of illustration only and changes and modifications can be made thereto without departing from the spirit and scope of the invention.

I claim:

1. A child resistant and senior friendly tamper evident package, said package comprising:

a blister sheet having at least one blister pocket projecting from a front side thereof, a depression formed in said blister sheet adjacent said blister pocket;

a rupturable foil layer sealed to a back side of said blister sheet to form a continuous cover over said blister pocket;

a paperboard layer having portions thereof adhered to said foil layer, a tear strip being formed in said paperboard layer, said tear strip being adhered to said foil about the periphery of said tear strip, a tab member connected to said tear strip at one end thereof;

the arrangement being such that when said tab and tear strip are removed, said foil then can be ruptured adjacent to said depression and said foil removed.

2. The package of claim 1 further including a paper adhered to said rupturable foil intermediate said rupturable foil layer and said paper board layer.

3. A child resistant and senior friendly tamper evident package, said package comprising:

a blister sheet having at least one blister pocket projecting from a front side thereof, a depression formed in said blister sheet adjacent said blister pocket;

a rupturable foil layer sealed to a back side of said blister sheet to form a continuous cover over said blister pocket;

a paperboard layer having portions thereof adhered to said foil layer, a tear strip being formed in said paperboard layer, said tear strip being adhered to said foil about the periphery of said tear strip, and a tab member connected to said tear strip at one end thereof, said tab member not being adhered to said foil layer.

* * * * *